US007909578B2

(12) United States Patent
Nishiyama et al.

(10) Patent No.: US 7,909,578 B2
(45) Date of Patent: Mar. 22, 2011

(54) TURBO MACHINE, COMPRESSOR IMPELLER USED FOR TURBO MACHINE, AND METHOD OF MANUFACTURING TURBO MACHINE

(75) Inventors: Toshihiko Nishiyama, Oyama (JP); Keiichi Inaba, Oyama (JP); Tetsuaki Ogawa, Oyama (JP); Hiroshi Sugito, Oyama (JP); Takahisa Iino, Oyama (JP)

(73) Assignee: Komatsu Ltd., Tokyo (JP)

( * ) Notice: Subject to any disclaimer, the term of this patent is extended or adjusted under 35 U.S.C. 154(b) by 1013 days.

(21) Appl. No.: 11/665,232

(22) PCT Filed: Oct. 18, 2005

(86) PCT No.: PCT/JP2005/019126

§ 371 (c)(1),
(2), (4) Date: Apr. 12, 2007

(87) PCT Pub. No.: WO2006/043556

PCT Pub. Date: Apr. 27, 2006

(65) Prior Publication Data

US 2007/0292268 A1 Dec. 20, 2007

(30) Foreign Application Priority Data

Oct. 19, 2004 (JP) ..... 2004-304473

(51) Int. Cl.
*F04D 29/22* (2006.01)

(52) U.S. Cl. ..... 416/204 A; 416/244 A

(58) Field of Classification Search ..... 416/244 A, 416/204 A

See application file for complete search history.

(56) References Cited

U.S. PATENT DOCUMENTS 3,961,867 A 6/1976 Woollenweber
4,340,317 A * 7/1982 Heitmann et al. ..... 416/244 A (Continued)

FOREIGN PATENT DOCUMENTS

EP 1 394 387 A2 3/2004

(Continued)

OTHER PUBLICATIONS

Chinese Office Action (and English translation thereof) dated Apr. 18, 2008, issued in a counterpart Chinese Application.

(Continued)

*Primary Examiner* — Richard Edgar
(74) *Attorney, Agent, or Firm* — Holtz, Holt, Goodman & Chick, PC

(57) ABSTRACT

A turbocharger as a turbo machine includes: a compressor impeller (13) having a projected portion (19) at a center of a rear surface; a drive shaft (15) connected to a bottomed coupling hole (20) provided in the projected portion (19) of the compressor impeller (13) through interference fit only; and a sleeve (30) with a cylindrical portion (33) connected to the outer peripheral portion of the projected portion (19) of the compressor impeller (13) by fitting only. The sleeve (30) is formed of a material whose coefficient of linear expansion is smaller than that of the compressor impeller (13). Accordingly, even when the coupling hole (20) in the projected portion (19) undergoes thermal expansion and the diameter of the coupling hole (20) increases, a connection between the drive shaft (15) and the coupling hole (20) can be prevented from being loosened since the radial increase thereof is suppressed by the cylindrical portion (33). Thus, the state of the connection thereof can be well maintained.

13 Claims, 7 Drawing Sheets

U.S. PATENT DOCUMENTS

| | | | | |
|---|---|---|---|---|
| 4,986,733 | A * | 1/1991 | Fleury et al. | 416/204 A |
| 5,176,497 | A * | 1/1993 | Deacon et al. | 416/204 A |
| 5,193,989 | A | 3/1993 | Fleury et al. | |
| 6,116,855 | A * | 9/2000 | Maki | 416/244 R |
| 6,896,479 | B2 * | 5/2005 | Svihla et al. | 416/244 R |
| 6,948,913 | B2 | 9/2005 | Heyes et al. | |
| 2004/0131469 | A1 | 7/2004 | Billington | |
| 2005/0036893 | A1 * | 2/2005 | Decker | 416/244 A |
| 2005/0169764 | A1 * | 8/2005 | Geoffrey Heyes et al. | 416/244 A |

FOREIGN PATENT DOCUMENTS

| | | | |
|---|---|---|---|
| GB | 2392477 | A | 3/2004 |
| JP | 50-30110 | A | 3/1975 |
| JP | 5-504178 | A | 7/1993 |
| JP | 2794338 | B2 | 6/1998 |
| JP | 2004-90130 | A | 3/2004 |
| JP | 2004-144095 | A | 5/2004 |
| WO | WO 91/06749 | A1 | 5/1991 |
| WO | WO 03/093651 | A1 | 11/2003 |

OTHER PUBLICATIONS

Notification Concerning Transmittal of International Preliminary Report on Patentability and Written Opinion, Chapter I of the Patent Cooperation Treaty for PCT/JP2005/019126, dated Jun. 5, 2007. 6 sheets.

* cited by examiner

TURBO MACHINE, COMPRESSOR IMPELLER USED FOR TURBO MACHINE, AND METHOD OF MANUFACTURING TURBO MACHINE

This application is a U.S. National Phase Application under 35 USC 371 of International Application PCT/JP2005/019126 filed Oct. 18, 2005.

TECHNICAL FIELD

The present invention relates to a turbo machine, a compressor impeller used for the turbo machine, and a method of manufacturing the turbo machine.

BACKGROUND ART

Conventionally, the compressor impeller of a turbo machine such as a turbocharger, is fixed to a drive shaft provided integrally with a turbine by means of a nut. That is, the compressor impeller has an axially extending through-hole, into which the drive shaft is inserted, and the nut is threadedly engaged with a screw portion provided on the distal end portion of the drive shaft, and fastened for fixation.

However, in such a connection structure, in which the compressor impeller is provided with a through-hole, high stress is liable to be generated at some midpoint in the axial direction thereof, and there is a limit to an improvement in terms of durability.

In view of this, there has been proposed a connection structure in which the compressor impeller is provided with, in stead of a through-hole, a bottomed screw hole (blind hole) extending in the axial direction, and in which the drive shaft is threadedly engaged with this screw hole (See, for example, Patent Document 1 and Patent Document 2). Further, in Patent Document 1 and Patent Document 2, there is provided a fit-engagement portion realized through interference fit of the drive shaft with the hole in order to eliminate back-lash in the threaded-engagement portion and to achieve an improvement in terms of concentricity.

In this connection structure, it is only necessary for the screw hole to be long enough to ensure reliable threaded engagement of the drive shaft, and there is no need for it to extend to a midpoint in the axial direction, so that generation of high stress is not easily involved.

[Patent Document 1] 05-504178 A

[Patent Document 2] U.S. Pat. No. 5,193,989

DISCLOSURE OF THE INVENTION

Problems to be Solved by the Invention

However, in the turbocharger as disclosed in Patent Document 1 and Patent Document 2, in effecting the connection, the drive shaft is first threadedly engaged with the screw hole on the compressor impeller side, and mutual fit-engagement is effected in the course of threaded engagement, so that the connection in the threaded-engagement portion, where concentricity is hard to attain, affects the fit-engagement portion, with the result that an accurate concentricity, which ought to be attained by the fit-engagement portion, cannot be achieved. As a result, various problems are involved; for example, the productivity of the turbocharger is impaired, and the drive shaft is deflected to suffer deformation, with the result that an unbalanced state is liable to arise during rotation, making it impossible to achieve an improvement in terms of durability as desired.

It is an object of the present invention to provide a turbo machine capable of maintaining a satisfactory connection between the compressor impeller and the drive shaft, a compressor impeller to be used in the turbo machine, and a method of manufacturing the turbo machine.

Means for Solving the Problems

A turbo machine according to a first invention includes: a compressor impeller having a projected portion at a center of a rear surface; a drive shaft fit-engaged with a bottomed coupling hole provided in the projected portion of the compressor impeller; and a cylindrical member fitted onto an outer peripheral portion of the projected portion corresponding to a fit-engaged portion of the drive shaft concentrically with the drive shaft.

A turbo machine according to a second invention is characterized in that: in the turbo machine according to the first invention, the fit-engagement of the bottomed coupling hole of the projected portion and the drive shaft is effected through interference fit as defined in JIS B 0401; and the fit-engagement of the projected portion and the cylindrical member is effected through transition fit or clearance fit as defined in JIS B 0401.

Here, the interference fit can be realized by fit-engaging a bottomed hole with a shaft whose diameter is larger than the hole diameter by approximately 10% by press-fitting, forcible press-fitting, shrinkage fit, expansion fit, etc.

The transition fit can be realized by fit-engaging the cylindrical member with the projected portion by slide fit, forcing-in, driving fit, etc.

More specifically, it is possible to adopt, as appropriate, interference fit, transition fit, or clearance fit by selecting the shaft diameter tolerance range class as shown in Table 1 when the hole diameter is 6 mm to 10 mm.

TABLE 1

| Reference | Shaft Diameter Tolerance Range | | | | | | | | | | | | | | |
|---|---|---|---|---|---|---|---|---|---|---|---|---|---|---|---|
| Hole | Transition Fit | | | | Clearance Fit | | | | | | Interference Fit | | | | |
| H6 | | | | g5 | h5 | js5 | k5 | m5 | | | | | | | |
| | | | f6 | g6 | h6 | js6 | k6 | m6 | n6 | p6 | | | | | |
| H7 | | | f6 | g6 | h6 | js6 | k6 | m6 | n6 | p6 | r6 | s6 | t6 | u6 | x6 |
| | | e7 | f7 | | h7 | js7 | | | | | | | | | |
| H8 | | | f7 | | h7 | | | | | | | | | | |
| | | e8 | f8 | | h8 | | | | | | | | | | |
| | d9 | e9 | | | | | | | | | | | | | |

TABLE 1-continued

| Reference | Shaft Diameter Tolerance Range | | | | | |
|---|---|---|---|---|---|---|
| Hole | | | Transition Fit | | Clearance Fit | Interference Fit |
| H9 | | | d8 | e8 | | |
| | | c9 | d9 | e9 | | |
| H10 | b9 | c9 | d9 | | | |

A turbo machine according to a third invention is characterized in that: in the turbo machine according to the first or second invention, the cylindrical member is formed of a material whose coefficient of linear expansion is smaller than that of the compressor impeller.

Here, as the material of the compressor impeller, it is possible to adopt, for example, aluminum (coefficient of linear expansion: $23.9\times10^{-6}$ l/C.°) and duralumin (coefficient of linear expansion: $27.3\times10^{-6}$ l/C.°).

As the material of the cylindrical member, it is possible to adopt, for example, carbon steel (coefficient of linear expansion: 10.1 to $12.1\times10^{-6}$ l/C.°), chromium steel (coefficient of linear expansion: 9.5 to $11.3\times10^{-6}$ l/C.°), nickel steel (coefficient of linear expansion: $18.0\times10^{-6}$ l/C.°), etc.

A turbo machine according to a fourth invention is characterized in that: in the turbo machine according to any one of the first through the third inventions, the drive shaft is provided with a step-like shoulder portion; and a sleeve fitted onto the drive shaft is held between the shoulder portion and the compressor impeller.

A turbo machine according to a fifth invention is characterized in that: in the turbo machine according to the fourth invention, the sleeve is held between the shoulder portion of the drive shaft and the compressor impeller while bearing axial contact pressure.

A turbo machine according to a sixth invention is characterized in that: in the turbo machine according to the fourth or fifth invention, the cylindrical member is integrally provided on the sleeve.

A turbo compressor according to a seventh invention is characterized in that the turbo machine according to any one of the fourth through the sixth inventions further includes: a housing rotatably supporting the drive shaft; a thrust collar fixed to the drive shaft; and a thrust bearing held between the thrust collar and the sleeve and fixed to the housing.

A turbo machine according to an eighth invention is characterized in that: in the turbo machine according to any one of the fourth through seventh inventions, the sleeve is equipped with a seal means effecting sealing on lubricating oil and high pressure air between the sleeve and a housing.

A turbo machine according to a ninth invention is characterized in that: in the turbo machine according to any one of the fourth through the eighth inventions, the sleeve and the drive shaft are provided with a first slippage suppressing means suppressing slippage in a rotating direction through mutual engagement.

A turbo machine according to a tenth invention is characterized in that: in the turbo machine according to any one of the first through the ninth inventions, the cylindrical member and the compressor impeller are provided with a second slippage suppressing means suppressing slippage in a rotating direction through mutual engagement.

A turbo machine according to an eleventh invention is characterized in that: in the turbo machine according to any one of the first through the tenth inventions, the compressor impeller and the drive shaft are provided with a third slippage suppressing means suppressing slippage in a rotating direction through mutual engagement.

A turbo machine according to a twelfth invention is characterized in that, in the turbo machine according to any one of the first through the eleventh inventions, the compressor impeller is equipped with an attachment/detachment means facilitating cancellation the fit-engagement of the drive shaft and the bottomed hole and the fit-engagement of the outer peripheral portion of the projected portion and the cylindrical member.

Here, it is desirable for the attachment/detachment means to be provided along the drive shaft connected to the compressor impeller and on the side opposite to the projected portion of the compressor impeller; for example, the attachment/detachment means may be formed by a female screw hole, a male screw, and a boss.

A compressor impeller according to a thirteenth invention for use in a turbo machine includes a cylindrical projected portion projected from a central portion of a rear surface, characterized in that an inner peripheral portion and an outer peripheral portion of the projected portion respectively constitute a first connecting portion and a second connecting portion for incorporation into the turbo machine.

According to a fourteenth invention, there is provided a method of manufacturing a turbo machine which includes: a compressor impeller having a projected portion at a center of a rear surface; a drive shaft fit-engaged with a bottomed coupling hole provided in the projected portion of the compressor impeller; a housing rotatably supporting the drive shaft; and a cylindrical member fitted onto an outer peripheral portion of the projected portion corresponding to the fit-engaged portion of the drive shaft concentrically with the drive shaft. The method includes the steps of: inserting the drive shaft into the housing to cause a distal end of the drive shaft to be exposed through the housing; fitting the cylindrical member onto the drive shaft; and press-fitting the distal end of the drive shaft into the coupling hole of the compressor impeller and press-fitting the cylindrical member onto the projected portion.

Effect of the Invention

According to the first invention as described above, the drive shaft is fit-engaged with the projected portion of the compressor impeller; the cylindrical member is fit-engaged with the outer periphery of this projected portion, so that even when the drive shaft and the compressor impeller attain high temperature as a result of the driving of the turbo machine, and the compressor impeller expands and the fit-engagement of the drive shaft is loosened, the fit-engagement of the cylindrical member on the outer peripheral side is enhanced, thus preventing the drive shaft from being easily detached from the projected portion of the compressor impeller and making it possible to reliably attain an improvement in terms of durability.

According to the second invention, the fit-engagement of the bottomed coupling hole of the projected portion and the drive shaft is effected through interference fit, and the fit-engagement of the projected portion and the cylindrical member is effected through transition fit or clearance fit, so that, even when press-fitting, etc. of the drive shaft into the bottomed coupling hole is effected to expand the outer periphery of the projected portion, it is possible to reliably fit-engage the cylindrical member with the outer periphery of the projected portion since the fit-engagement between the projected portion and cylindrical member is loosened.

According to the third invention, the cylindrical member is formed of a material whose coefficient of linear expansion is smaller than that of the compressor impeller, whereby, even if the compressor impeller attains high temperature and expands, the fit-engagement in the outer periphery is further tightened since the expansion of the cylindrical member as a result of the increase in temperature is smaller than that of the compressor impeller, making it possible to maintain a firm fit-engagement between the drive shaft and the compressor impeller.

According to the fourth invention, it is possible to arrange the compressor impeller, the sleeve, etc. at appropriate axial positions on the drive shaft.

According to the fifth invention, the sleeve is held between the compressor impeller and the shoulder portion while bearing a contact pressure, so that it is possible to rotate the sleeve reliably together with the drive shaft.

According to the sixth invention, the cylindrical member is provided integrally with the sleeve, so that it is possible to reduce the number of components and assemblage man-hours.

According to the seventh invention, the thrust bearing is held between the sleeve and the thrust collar, so that it is possible to reliably prevent the drive shaft from being axially deviated through the sleeve and the thrust collar. Further, due to the construction in which the thrust bearing is held between two components, unlike the construction in which a peripheral groove is provided in the sleeve and in which a horseshoe-shaped thrust bearing is arranged in this groove, it is possible to use an annular thrust bearing, making it possible to support the rotating surface over the entire periphery in a well-balanced manner.

According to the eighth embodiment, the sleeve is provided with a seal means for sealing up lubricating oil and high pressure air, so that there is no fear of the high pressure supply air on the compressor impeller side entering the lubricated portion of the drive shaft and leaking therethrough, or the lubricating oil in the lubricated portion leaking out to the supercharged air side to get mixed therein.

According the ninth invention, the sleeve and the drive shaft are provided with the first slippage suppressing means, so that it is possible to integrally rotate the sleeve and the drive shaft, making it possible to prevent seizure or the like from occurring therebetween.

According to the tenth and eleventh inventions, the cylindrical member and the compressor impeller are provided with the second slippage suppressing means, and the compressor impeller and the drive shaft are provided with the third slippage suppressing means, so that, as compared with the case in which the connection is effected through mutual fitting only, the burden on the connection surfaces can be mitigated, making it possible to reliably cope with slippage.

According to the twelfth invention, the compressor impeller is provided with the attachment/detachment means, whereby it is possible to easily cancel the fit-engagement between the compressor impeller and the drive shaft by using the attachment/detachment means, so that it is possible to perform repair easily at the time of failure.

According to the thirteenth invention, the compressor impeller is incorporated into the turbo machine by utilizing the connecting portions of both the outer peripheral portion and the inner peripheral portion of the projected portion, so that, as compared with the prior-art technique, in which the connection is effected by utilizing the inner peripheral portion, it is possible to enhance the connection strength, making it possible to achieve an improvement in terms of durability.

According to the fourteenth invention, it is possible to fit the cylindrical member onto the drive shaft after the insertion of the drive shaft into the housing, and to sequentially effect the press-fitting thereof into the coupling hole of the compressor impeller and the press-fitting of the cylindrical member onto the projected portion, so that the assembly operation is easy to perform, and it is possible to shorten the requisite time for incorporation.

EXPLANATION OF CODES

1 . . . turbocharger (turbo machine), 13 . . . compressor impeller, 15 . . . drive shaft, 16 . . . housing (non-rotating member), 18 . . . shoulder portion, 19 . . . projected portion, 19A . . . second connecting portion, 20 . . . coupling hole, 20A . . . first connecting portion, 30 . . . sleeve, 31 . . . thrust collar, 32 . . . thrust bearing, 33 . . . cylindrical portion (cylindrical member), 34 . . . seal ring (seal means), 43, 56 . . . first slippage suppressing means, 46 . . . second slippage suppressing means, 49, 53 . . . third slippage suppressing means

BEST MODE FOR CARRYING OUT THE INVENTION

In the following, embodiments of the present invention will be described with reference to the drawings. From the second embodiment onward, described below, the members that are the same as those of the first embodiment described below are indicated by the same reference symbols, and a detailed description thereof will be omitted or simplified from the second embodiment onward.

First Embodiment

Figure 1:
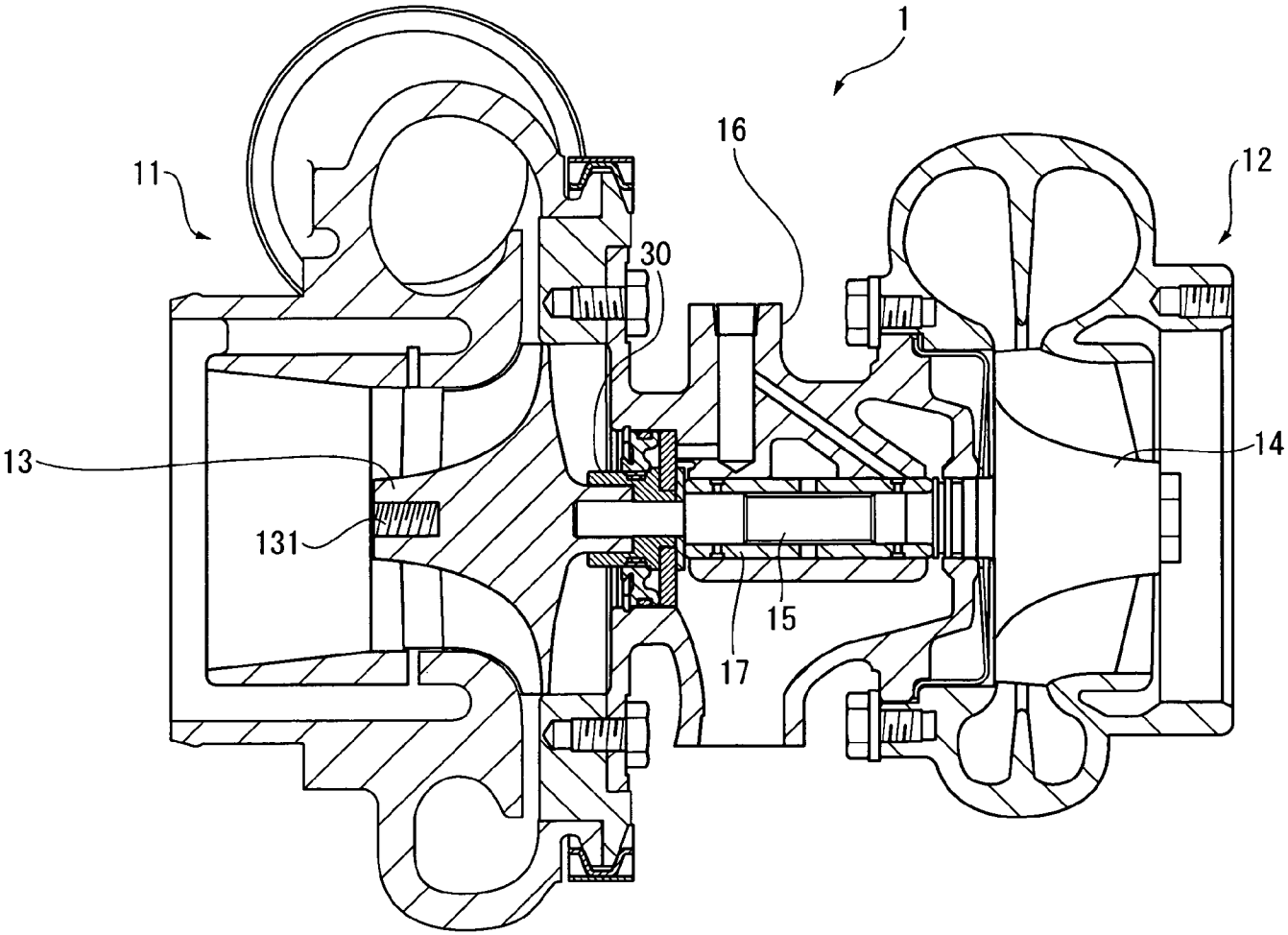
FIG. 1 is a sectional view of a turbo machine according to a first embodiment of the present invention.
Figure 2:
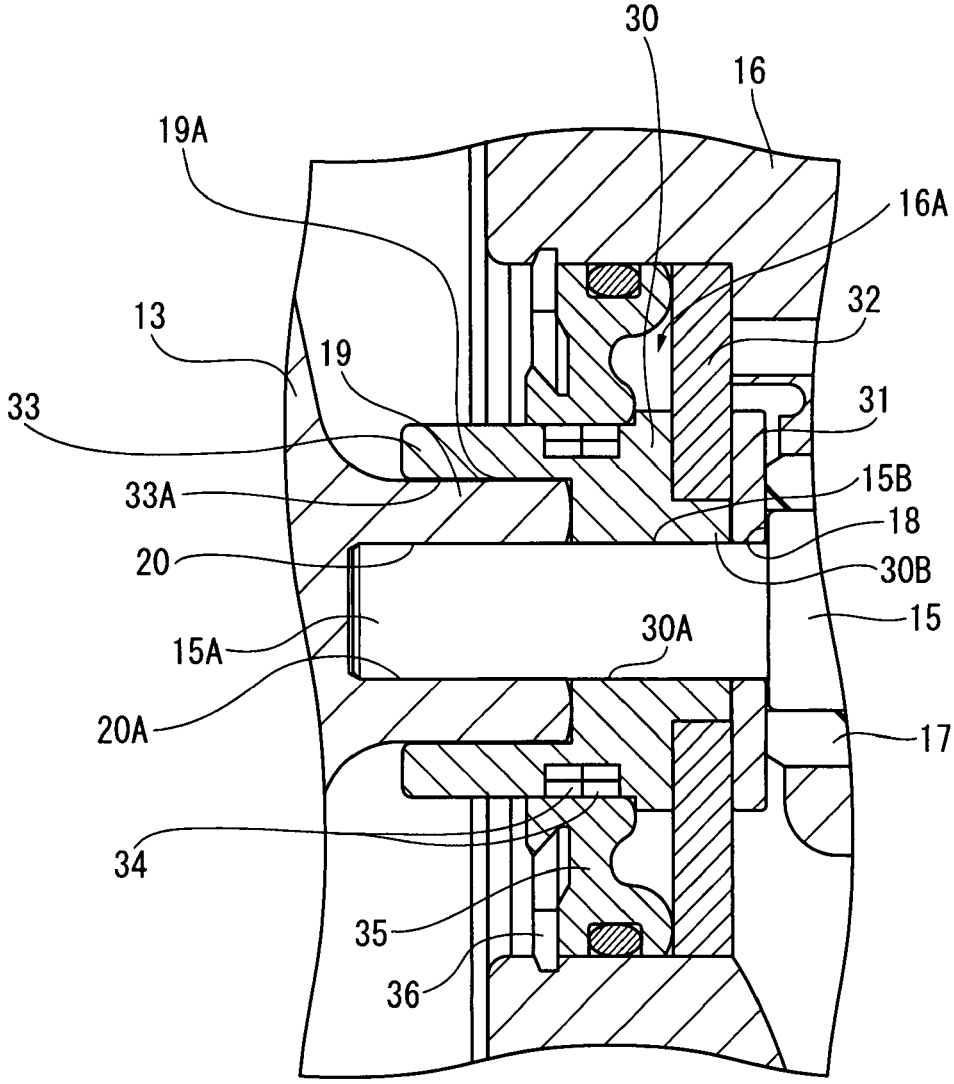
FIG. 2 is a sectional view of a main portion of the turbo machine.

FIG. 1 is a sectional view of a turbocharger (turbo machine) 1 according to the first embodiment of the present invention, and FIG. 2 is a sectional view of a main portion of the turbocharger 1.

As shown in FIG. 1, the turbocharger 1, which is to be mounted, for example, in a gasoline engine or a diesel engine, is equipped with a compressor 11 connected to a midpoint of an intake pipe leading to an engine (not shown), and an exhaust turbine 12 connected to a midpoint of an exhaust pipe.

The compressor 11 has a compressor impeller 13 for compressing intake air from the outside through rotation.

Although not shown, the compressor impeller 13 has a hub substantially circular in front view and a plurality of vanes mounted thereto so as to be arranged in the rotating direction of the hub, and is formed of aluminum alloy casting. Substantially the central portion of the compressor impeller 13 protrudes in a chevron-like fashion, and at the flat forward end thereof, there is formed a female screw hole 131 as an attachment/detachment means. After the compressor impeller 13 has been fit-engaged with a drive shaft 15 by manufacturing procedures described below, the female screw hole 131 is used when they are to be separated from each other again. In this embodiment, it is provided in order to facilitate the separation, which is effected by threadedly engaging a removing tool (not shown) with the female screw 131 and pulling the removing tool.

The exhaust turbine 12 has a turbine wheel 14, which is rotated by exhaust gas that flows in; the turbine wheel 14 is formed integrally with the steel drive shaft 15 by friction welding, TIG welding, MIG welding or the like. The drive shaft 15 is rotatably supported by a full float bearing 17 provided in a housing 16, with the compressor impeller 13 being connected to the distal end of the drive shaft 15.

In the following, with reference to FIG. 2, the connecting portion between the compressor impeller 13 and the drive shaft 15 will be described in detail.

At the center of the rear side of the compressor impeller 13, that is, at the center of the side thereof opposed to the turbine wheel 14, there is provided a projected portion 19 projected toward the turbine wheel 14 side. In the projected portion 19, there is provided a coupling hole 20 extending axially toward the depth side thereof.

The drive shaft 15 is to be inserted into the coupling hole 20 for connection; unlike the conventional coupling hole, which is a through-hole extending through the compressor impeller 13, the coupling hole 20 is a bottomed hole. The inner peripheral portion of the coupling hole 20 constitutes a first connecting portion 20A to be connected with the drive shaft 15.

At the distal end of the drive shaft 15, there is provided a fit-engagement shaft portion 15A to be inserted into the coupling hole 20 of the compressor impeller 13 and fit-engaged with the first connecting portion 20A thereof; on the proximal end side with respect to the fit-engagement shaft portion 15A, there is provided an insert portion 15B onto which a sleeve 30 is to be fitted.

The fit-engagement between the fit-engagement shaft portion 15A and the first connecting portion 20A is effected through interference fit on a hole basis (e.g., H6/u6 in terms of JIS fit symbol). No other fixation structure such as a conventional one using a screw is adopted; the connection is effected solely through fit-engagement between the compressor impeller 13 and the drive shaft 15.

The sleeve 30 is formed of a substantially cylindrical member that is open on the compressor impeller 13 side; it is formed of steel, whose coefficient of linear expansion is smaller than that of the compressor impeller 13, which is formed of aluminum.

The sleeve 30 is equipped with an insertion hole 30A into which the drive shaft 15 is to be inserted; on the compressor impeller 13 side with respect to the insertion hole 30A, there is integrally provided a cylindrical portion (cylindrical member) 33 having a fit-engagement hole portion 33A communicating with the insertion hole 30A.

The fit-engagement hole portion 33A of the cylindrical portion 33 is of a diameter larger than the insertion hole 30A; the projected portion 19 of the compressor impeller 13 is inserted thereinto for fit-engagement. That is, the outer peripheral portion of the projected portion 19 to be inserted constitutes a second connecting portion 19A to be connected with the fit-engagement hole portion 33A.

The fit-engagement between the fit-engagement hole portion 33A and the second connecting portion 19A is effected through clearance fit or transition fit on a hole basis (e.g., H6/h6, H6/k6 in terms of JIS fit symbol); the fit-engagement between the fit-engagement shaft portion 15A and the first connecting portion 20A is set tighter than that.

As a result, the concentricity between the drive shaft 15 and the compressor impeller 13 is reliably secured without being affected by the fit-engagement between the fit-engagement hole portion 33A and the second connecting portion 19A. Here also, there is no fixation structure such as one using a screw is adopted, and the connection between the compressor impeller 13 and the cylindrical portion 33 (sleeve 30) is effected solely through fit-engagement.

In this way, the second connecting portion 19A of the projected portion 19 is fit-engaged with the cylindrical portion 33 whose coefficient of linear expansion is smaller than that of the compressor impeller 13, so that, even when the drive shaft 15 and the compressor impeller 13 attain high temperature, and the compressor impeller 13 side portion undergoes thermal expansion and the diameter of the coupling hole 20 tends to increase, it is possible to suppress the expansion by the cylindrical portion 33, enabling to prevent the drive shaft 15 from becoming subject to detachment from the coupling hole 20 of the projected portion 19 and to reliably achieve an improvement in terms of durability.

Further, instead of a through-hole, the bottomed coupling hole 20 is provided on the compressor impeller 13 side, so that high stress is not easily generated in the inner central portion of the compressor impeller 13, making it possible to achieve a substantial improvement in terms of durability.

Further, the drive shaft 15 and the compressor impeller 13 are not connected together through threaded engagement but are connected together solely by fit-engagement through interference fit between the first connecting portion 20A and the fit-engagement shaft portion 15A, so that the assembly can be conducted with high precision due to the concentricity of the fit-engagement portion; further, unlike the conventional threaded-engagement connection structure, it involves no deformation of the drive shaft 15, galling of the thread portions, etc., thus providing a satisfactory assembly property.

Further, through the fit-engagement between the compressor impeller 13 and the drive shaft 15, the sleeve 30 is pressed against a step-like shoulder portion 18 provided on the drive shaft 15, and is held between the compressor impeller 13 and the shoulder portion 18 under an axial contact pressure. Thus, although the sleeve 30 is not connected with the drive shaft 15, it is held under a contact pressure, whereby the compressor impeller 13 and the sleeve 30 are arranged at appropriate axial positions on the drive shaft 15, and the sleeve 30 rotates integrally with the drive shaft 15.

Between the sleeve 30 and the shoulder portion 18, there is arranged a thrust collar 31, which is also held under a contact pressure, and is fixed to the drive shaft 15 to rotate integrally therewith.

Further, on the outer peripheral side of an abutment portion 30B of the sleeve 30 abutting the thrust collar 31, there is arranged a thrust bearing 32 so as to be held between the sleeve 30 and the thrust collar 31. The thrust bearing 32 is formed as an annular member allowing insertion of the abutment portion 30B, and is fixed in position within a recessed space 16A provided in the housing 16. Unlike a horse-shoe-shaped thrust bearing, the annular thrust bearing 32 can support the rotating surfaces of the sleeve 30 and the thrust collar 31 over the entire periphery in a well-balanced manner.

The sleeve 30 is arranged so as to be accommodated within the recessed space 16A of the housing 16, with the above-mentioned cylindrical portion 33 slightly protruding from the recessed space 16A toward the compressor impeller 13 side. In the outer periphery of the proximal end portion of the cylindrical portion 33, there is formed a recessed groove over the entire periphery thereof, and a pair of seal rings (seal means) 34 are fitted in the recessed groove so as to be axially arranged side by side.

The seal rings 34 are held in contact with a retaining ring 35 arranged within the recessed space 16A so as to cover the thrust bearing 32, effecting sealing between the interior and the exterior of the recessed space 16A. That is, due to the seal rings 34, there is no fear of the lubricating oil supplied to the thrust bearing 32 leaking from the recessed space 16A side to the compressor impeller 13 side or the high pressure supply air generated on the compressor impeller 13 side leaking through the lubricated portion in the recessed space 16A. On the outer side of the retaining ring 35, there is provided a lock ring 36, which prevents the retaining ring 35 from being detached from the recessed space 16A.

When manufacturing the turbocharger 1, the full float bearing 17 is first arranged in the housing 16, and the drive shaft 15, which is integrated with the turbine wheel 14, is inserted into the full float bearing 17 from the exhaust turbine 12 side.

After that, the thrust collar 31 is fitted onto the drive shaft 15 protruding from the recessed space 16A of the housing 16, and the thrust bearing 32, the retaining ring 35, and the lock ring 36 are successively arranged within the recessed space 16A, and further, the sleeve 30 is fitted onto the drive shaft 15.

Since the cylindrical portion 33 is integrally provided on the sleeve 30, there is no need to incorporate the cylindrical portion 33 as a separate component.

Then, the fit-engagement shaft portion 15A of the drive shaft 15 is press-fitted into the coupling hole 20, and the cylindrical portion 33 is press-fitted onto the outer peripheral surface of the projected portion 19 for fit-engagement. By the above-mentioned procedures, the incorporation of the compressor impeller 13 into the turbocharger 1 is completed.

Second Embodiment

Next, the second embodiment of the present invention will be described.

In the first embodiment described above, the distal end portion of the drive shaft 15 has a columnar configuration, and is press-fitted into the circular bottomed hole 20 for fit-engagement; further, the cylindrical portion 33 is fixed to the columnar projected portion 19 for fit-engagement.

Figure 3:
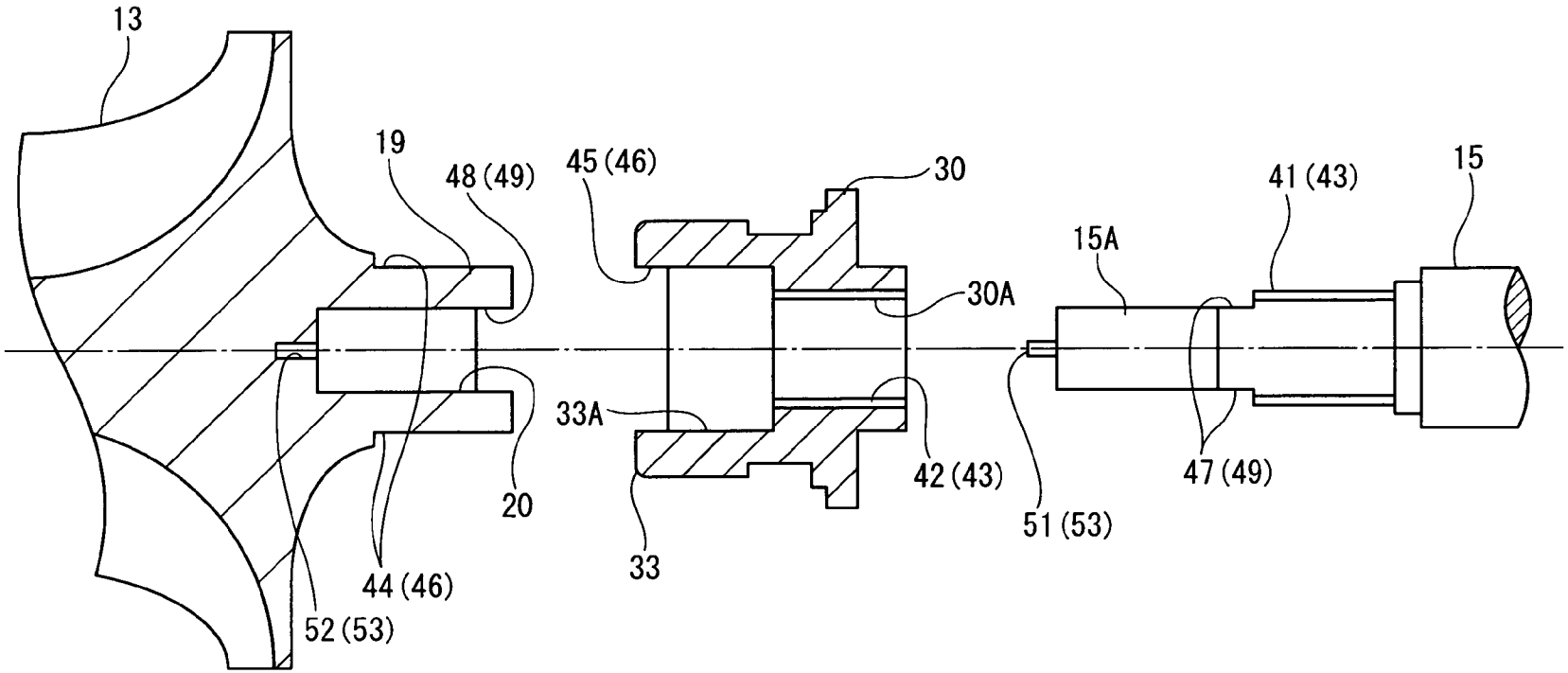
FIG. 3 is a sectional view of a connecting portion according to a second embodiment of the present invention.
Figure 4:
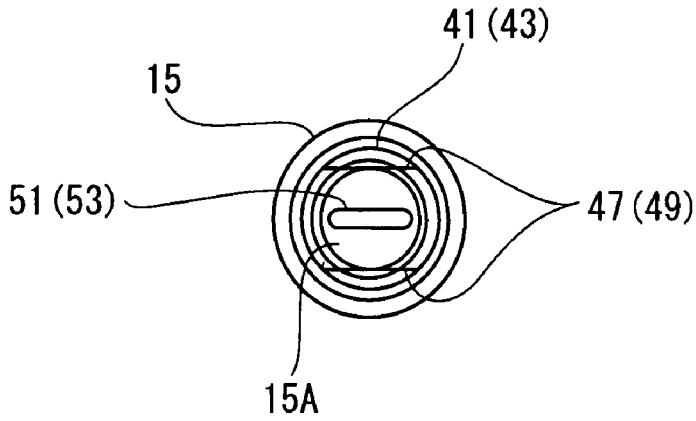
FIG. 4 is a front view of a drive shaft according to the embodiment.

In contrast, in the second embodiment of the present invention, as shown in FIG. 3, slippage suppressing means 43, 46, 49 for suppressing slippage in the rotating direction are provided in the connecting portions between the compressor impeller 13, the drive shaft 15, and the sleeve 30. FIG. 4 is a front view of the drive shaft 15, FIG. 5 is a front view of the sleeve 30, and FIG. 6 is a front view of the compressor impeller 13.

As shown in FIG. 3, a male screw portion 41 is provided on the portion of the drive shaft 15 to which the sleeve 30 is to be mounted; provided in the sleeve 30 is a female screw portion 42 to be threadedly engaged with the male screw portion 41; through threaded engagement of these portions, the sleeve 30 is mounted to the drive shaft 15, and is prevented from slipping or idling around the drive shaft 15. That is, the screw portions 41 and 42 constitute the first slippage suppressing means 43 of the present invention.

Figure 5:
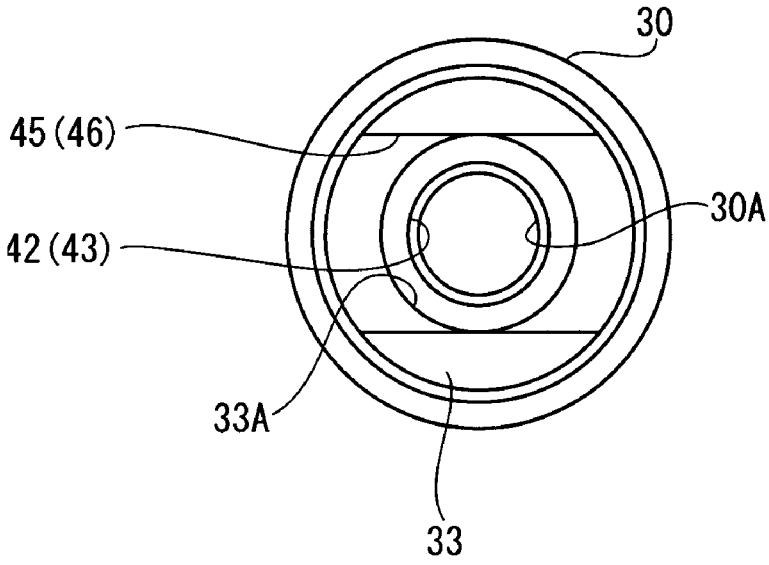
FIG. 5 is a front view of a sleeve according to the embodiment.
Figure 6:
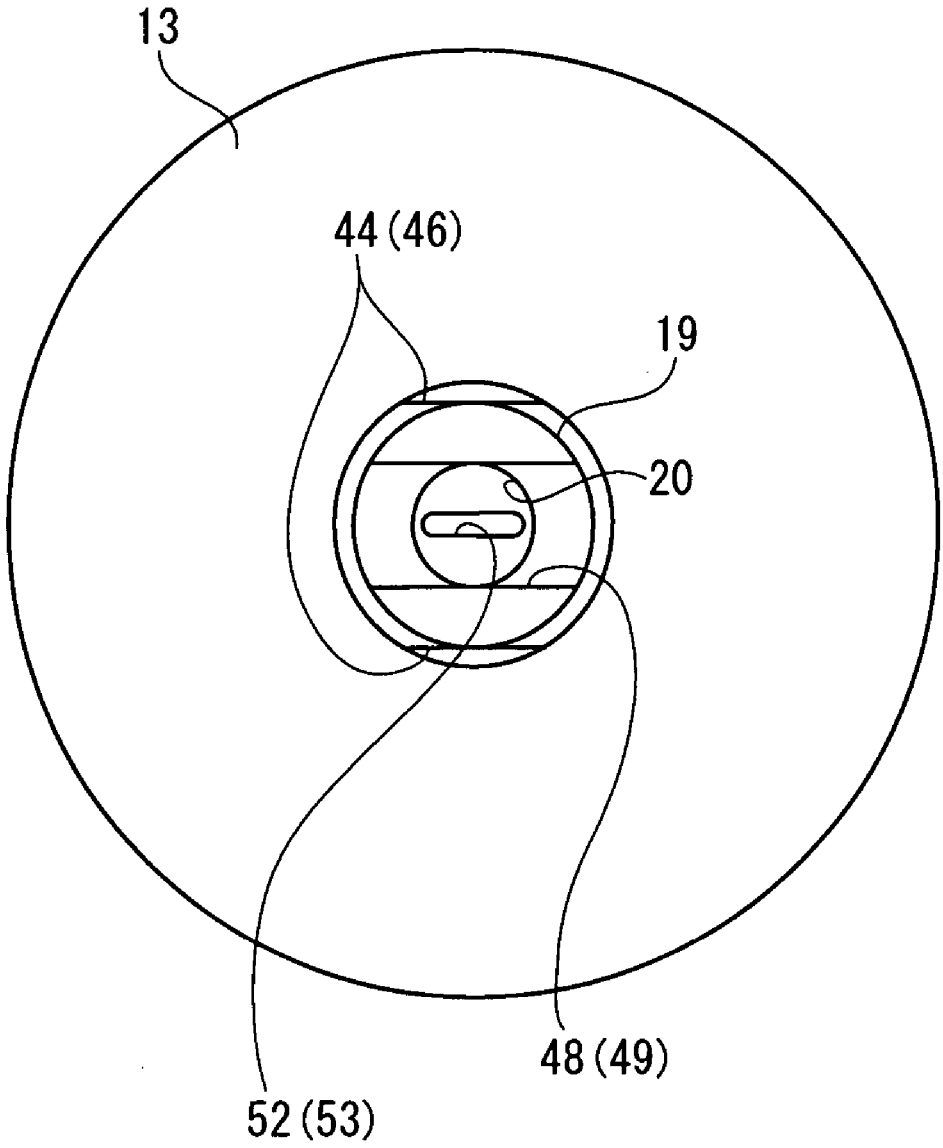
FIG. 6 is a front view of a compressor impeller according to the embodiment.

As shown in FIG. 6, in the compressor impeller 13, width across flat portions are formed by a pair of parallel flat surfaces 44 at the proximal end of the outer peripheral portion of the projected portion 19, and as shown in FIG. 5, in the cylindrical portion 33 of the sleeve 30, there is formed a lock groove 45 to be locked to the flat surfaces 44. In the state in which the projected portion 19 and the sleeve 30 are fit-engaged with each other, the lock groove 45 is locked to the flat surfaces 44, and slippage in the rotating direction is suppressed between the cylindrical portion 33 and the projected portion 19. That is, a second slippage suppressing means 46 according to the present invention is formed by the flat surfaces 44 and the lock groove 45.

Further, as shown in FIG. 4, in the drive shaft 15, width across flat portions are formed by a pair of parallel flat surfaces 47 also at the proximal end of the fit-engagement shaft portion 15A, and as shown in FIG. 6, a lock groove 48 to be locked to the flat surfaces 47 is provided in the projected portion 19 of the compressor impeller 13. In the state in which the drive shaft 15 and the projected portion 19 are fit-engaged with each other, the lock groove 48 is locked to the flat surfaces 47, thereby suppressing slippage in the rotating direction between the drive shaft 15 and the projected portion 19. That is, a third slippage suppressing means 49 according to the present invention is formed by the flat surfaces 47 and the lock groove 48.

In addition, at the distal end of the drive shaft 15, there is provided an engagement member 51 protruding toward the forward end, and the engagement member 51 enters an engagement hole 52 provided in the depth portion of the coupling hole 20 of the projected portion 19, and is engaged therewith. Also through the engagement between the engagement member 51 and the engagement hole 52, slippage in the rotating direction is suppressed between the drive shaft 15 and the projected portion 19, so that the engagement member 51 and the engagement hole 52 constitute a third slippage suppressing means 53 according to the present invention.

Third Embodiment

FIGS. 7A, 7B, 8A, and 8B show, as the third embodiment of the present invention, still another modification of the drive shaft 15 and the sleeve 30. While the first slippage suppressing means 43 of the second embodiment is formed by the male screw portion 41 of the drive shaft 15 and the female screw portion 42 of the sleeve 30, in this embodiment, a first slippage suppressing means 56 is formed by a width across flat structure.

Figure 7A:
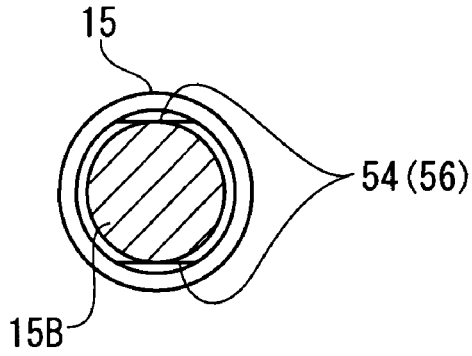
FIG. 7A is a sectional view, taken along the line A-A of FIG. 7B, of a connecting portion according to a third embodiment of the present invention.
Figure 7B:
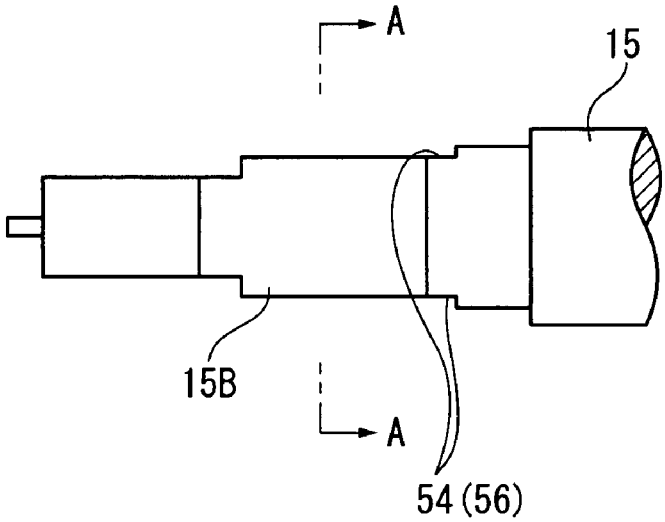
FIG. 7B is a side view of a drive shaft according to the embodiment.
Figure 8A:
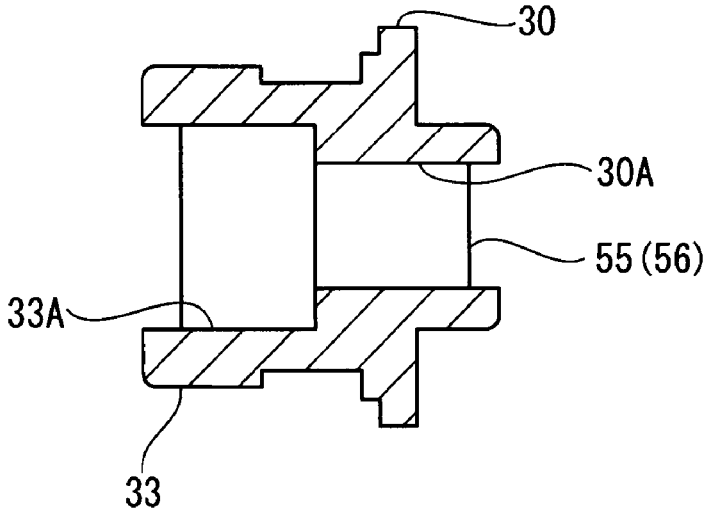
FIG. 8A is a side sectional view of a sleeve according to the embodiment.
Figure 8B:
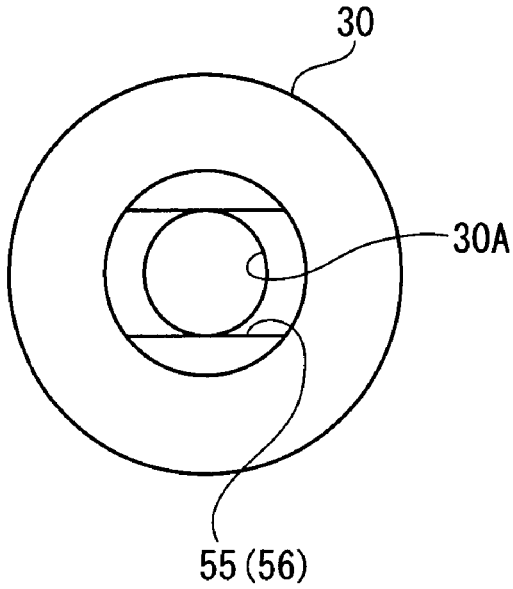
FIG. 8B is a rear view of the sleeve of the embodiment.

More specifically, as shown in FIGS. 7A and 7B, at the proximal end of the insertion portion 15B of the drive shaft 15 (the portion into which the sleeve 30 is inserted), width across flat portions are formed by a pair of parallel flat surfaces 54, and at the outer opening portion of the insertion hole 30A of the sleeve 30 shown in FIGS. 8A and 8B, there is provided a lock groove 55 to be locked to the flat surfaces 54. In the state in which the sleeve 30 is fitted onto the drive shaft 15, the lock groove 55 is locked to the flat surfaces 54, and slippage in the rotating direction is suppressed between the drive shaft 15 and the sleeve 30. That is, the first slippage suppressing means 56 is formed by the flat surfaces 54 and the lock groove 55. Otherwise, this embodiment is substantially of the same configuration as the second embodiment.

The present invention is not restricted to the above-mentioned embodiments but includes other constructions, etc. allowing achievement of the object of the present invention; for example, the following modifications are to be covered by the scope of the present invention.

For example, while in the second and third embodiments there are provided the first through third slippage suppressing means 43, 46, 49, 53, 56, it is also possible to omit the second slippage suppressing means 46 since no slippage will naturally occur between the compressor 13 and the sleeve 30 if the third slippage suppressing means 49 and 53 are provided on the drive shaft 15 and the compressor impeller 13.

While in the above-mentioned embodiments the cylindrical portion 33 is provided integrally on the sleeve 30, it is also possible for the cylindrical portion 33 to be provided separately from the sleeve 30 as an annular cylindrical member. Also in the case in which a separate cylindrical member is adopted, the material of the cylindrical member has a coefficient of linear expansion smaller than that of the compressor impeller 13, and is fit-engaged with the projected portion 19.

The most preferable constructions and method for carrying out the present invention disclosed by the above description should not be construed restrictively. That is, while the present invention has been depicted and illustrated mainly with reference to specific embodiments, it is possible for those skilled in the art to make various modifications of the above embodiments in terms of configuration, amount, and other details without departing from the scope of technical idea and object of the present invention.

Thus, the configurations, amounts, etc. in the above-mentioned embodiments are only given by way of example to facilitate the understanding of the present invention, and restrict in no way the present invention, so that any description in which the components are referred to with some or none of the above-mentioned restrictions in terms of configuration, amount, etc. is to be covered by the scope of the present invention.

INDUSTRIAL APPLICABILITY

Apart from a turbocharger to be mounted in a gasoline engine or a diesel engine, the present invention is also applicable to other turbo machines equipped with a compressor impeller and a drive shaft for driving the same, such as a turbo compressor, a turbo jet, a turbo blower, and a turbo refrigerator.

The invention claimed is:

1. A turbo machine, comprising:

a compressor impeller having a projected portion at a center of a rear surface;

a drive shaft fit-engaged by an interference fit solely and directly with a bottomed coupling hole provided in the projected portion of the compressor impeller; and a cylindrical member fitted by a transition fit or a clearance fit onto an outer peripheral portion of the projected portion corresponding to a fit-engaged portion of the drive shaft concentrically with the drive shaft.

2. The turbo machine according to claim 1, wherein the cylindrical member is formed of a material whose coefficient of linear expansion is smaller than that of the compressor impeller.

3. The turbo machine according to claim 1, wherein the drive shaft is provided with a step-like shoulder portion; and a sleeve fitted onto the drive shaft is held between the shoulder portion and the compressor impeller.

4. The turbo machine according to claim 3, wherein the sleeve is held between the shoulder portion of the drive shaft and the compressor impeller while bearing axial contact pressure.

5. The turbo machine according to claim 3, wherein the cylindrical member is integrally provided on the sleeve.

6. The turbo machine according to claim 3, further comprising:

a housing rotatably supporting the drive shaft;

a thrust collar fixed to the drive shaft; and a thrust bearing held between the thrust collar and the sleeve and fixed to the housing.

7. The turbo machine according to claim 3, wherein the sleeve is equipped with a seal that effects sealing on lubricating oil and high pressure air between the sleeve and a housing.

8. The turbo machine according to claim 3, wherein the sleeve and the drive shaft are provided with a first slippage suppressor that suppresses slippage in a rotating direction through mutual engagement.

9. The turbo machine according to claim 1, wherein the cylindrical member and the compressor impeller are provided with a second slippage suppressor that suppresses slippage in a rotating direction through mutual engagement.

10. The turbo machine according to claim 1, wherein the compressor impeller and the drive shaft are provided with a third slippage suppressor that suppresses slippage in a rotating direction through mutual engagement.

11. The turbo machine according to claim 1, wherein the compressor impeller is equipped with an attachment and a detacher that facilitates cancellation of the interference fit of the drive shaft and the bottomed hole and of the transition fit or clearance fit of the outer peripheral portion of the projected portion and the cylindrical member.

12. A compressor impeller for use in a turbo machine, comprising:

a cylindrical projected portion projected from a central portion of a rear surface, wherein an inner peripheral portion of the projected portion constitutes a first connecting portion for fit-engagement by an interference fit solely and directly with a drive shaft of the turbo machine, and an outer peripheral portion of the projected portion constitutes a second connecting portion for fit-engagement by a transition fit or a clearance fit with a cylindrical member provided concentrically with the drive shaft.

13. A method of manufacturing a turbo machine which includes:

a compressor impeller having a projected portion at a center of a rear surface;

a drive shaft fit-engaged with a bottomed coupling hole provided in the projected portion of the compressor impeller;

a housing rotatably supporting the drive shaft; and a cylindrical member fitted onto an outer peripheral portion of the projected portion corresponding to a fit-engaged portion of the drive shaft concentrically with the drive shaft, the method comprising:

inserting the drive shaft into the housing to cause a distal end of the drive shaft to be exposed through the housing;

fitting the cylindrical member onto the drive shaft;

interference-fitting the distal end of the drive shaft solely and directly into the coupling hole of the compressor impeller; and transition-fitting or clearance-fitting the cylindrical member onto the outer peripheral portion of the projected portion.

* * * * *